US008276838B2

(12) United States Patent
Tai et al.

(10) Patent No.: US 8,276,838 B2
(45) Date of Patent: Oct. 2, 2012

(54) GENERAL WINDING AND FEEDING APPARATUS

(75) Inventors: Feng-Yi Tai, Chung-Ho (TW); Ta-Cheng Hsiung, Hsinchu (TW); Chien-Hua Chen, Taipei (TW)

(73) Assignee: Godex International Co., Ltd., Taipei Hsien (TW)

( * ) Notice: Subject to any disclaimer, the term of this patent is extended or adjusted under 35 U.S.C. 154(b) by 142 days.

(21) Appl. No.: 12/945,887

(22) Filed: Nov. 14, 2010

(65) Prior Publication Data

US 2012/0119012 A1 May 17, 2012

(51) Int. Cl.
*B65H 23/18* (2006.01)

(52) U.S. Cl. ..... 242/413.3; 242/413.9; 242/420.6

(58) Field of Classification Search ..... 242/413.3, 242/413.5, 413.9, 416, 417, 417.3, 420.5–420.6
See application file for complete search history.

(56) References Cited

U.S. PATENT DOCUMENTS

| | | | | |
|---|---|---|---|---|
| 6,807,998 | B2 * | 10/2004 | Dods | 156/361 |
| 6,823,916 | B2 * | 11/2004 | Dods | 156/358 |
| 6,845,800 | B2 * | 1/2005 | Dods et al. | 156/542 |
| 7,543,773 | B2 * | 6/2009 | Lenkl | 242/417.3 |
| 2011/0006148 | A1 * | 1/2011 | Tolrud et al. | 242/413.1 |

* cited by examiner

*Primary Examiner* — Sang Kim

(57) ABSTRACT

A general winding and feeding apparatus includes a rotating shaft on the upper side of a standing wall of a base, and a motor is connected to the rotating shaft in the standing wall. A swing arm extends across a traveling material and is situated at a suitable position on the standing wall. Digital variable frequency methods may be used to drive the motor, which operates in conjunction with light-coupled sensors to detect the traveling speed of a material on the swing arm and sense a swing position of the swing arm. Feedback is generated in real-time to modify the speed of the motor, and the constant speed travel of the material can be achieved while being either wound or unwound.

16 Claims, 8 Drawing Sheets

GENERAL WINDING AND FEEDING APPARATUS

BACKGROUND OF THE INVENTION

1. Field of the Invention

The present invention relates to a general winding and feeding apparatus, and more particularly to an apparatus in which digital frequency variation technology is adopted to drive a motor, and optically coupled sensing technology operates in coordination therewith to detect the traveling speed of a material on a swinging arm and sense the swing position of the swinging arm. Whereby, feedback is utilized to properly modify the rotating speed of the motor, achieving constant-speed feeding of the material while being winding or feeding.

2. Background

A conventional winder structure primarily includes a rotating shaft projecting above a standing wall of a base and used for engaging with a spool around which a material can be wound, where a motor is installed in the standing wall and connected to the rotating shaft thereby providing a rotating power. In addition, a swinging arm is installed at a suitable position on the standing wall and extends across a traveling material. A buffering tension is achieved through the weight of the rolling shaft itself, and the material can be wound tightly without loosening.

The coupling structure is simple, but the use thereof is substantially broad; it can be used in a variety of different industries, for example, it can be used in the continuous winding of a long wire, paper or metal material such that it satisfies a significant extent of the market's needs. However, the conventional winder structure is used almost exclusively for material winding and not for material feed-out, and as such the operations thereof are limited.

Furthermore, the motor of a conventional winder is almost always driven directly by a DC motor or a synchronous AC motor, ensuring that the rotating speeds of the rotating shafts connected to each other are the same. Therefore, the distance of adjacent winding circles changes as the material winding radius increases gradually during the material winding operations, making it nearly impossible to allocate paper feeding speeds relatively, and consequently, the rotating speeds of the inner and outer layers of the paper are not uniform.

SUMMARY OF THE INVENTION

To improve the problems of conventional winders mentioned above, the present invention is proposed.

Embodiments of the present invention disclose a general purpose winding and feeding apparatus, which includes:

a base, a standing wall disposed on an upper side thereof, and a bottom plate disposed on a bottom thereof;

a rotating shaft disposed on an upper side of the standing wall of the base and used for winding or releasing a material;

a motor, driven by means of digital variable frequency technology, installed in the standing wall of the base and connected to the rotating shaft, thereby providing rotating power;

a swing arm, one end thereof having a fixed shaft disposed on the standing wall, a positioning hole plate disposed on the fixed shaft, another end thereof having a rod thereby allowing the swing arm to extend across a traveling material, a grating wheel installed in the rod; and at least two light-coupled sensors, a first light-coupled sensor installed in the swing arm and corresponding to the grating wheel of the rod of the swing arm, thereby detecting rotating speeds thereof, a second light-coupled sensor thereof installed in the standing wall of the base and corresponding to the positing hole plate of the fixed shaft of the swing arm, thereby detecting swing positions thereof;

whereby, a user can set a material feed speed in inches per second alone, automatically adjusting a relative position and rotating speed, a material traveling speed and the swing position of the swing arm both detected by the two light-coupled sensors during material winding or feeding operations so as to yield feedback to modify the rotating speed of the motor, achieving the object of maintaining a constant feed speed of the material.

In addition, an indication lamp, which is lit to indicate whether the rotating shaft is rotated clockwise or anticlockwise, may further respectively be installed on both left and right sides of the swing arm additionally according to embodiments of the present invention so as to allow the user to differentiate easily whether the machine is being operated in a material winding state or feeding state.

Furthermore, embodiments of the present invention may further include a fast spool axle center fixing module capable of coupling to a variety of different diameters of material shafts with the rotating shaft, thereby loading and unloading the material quickly.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
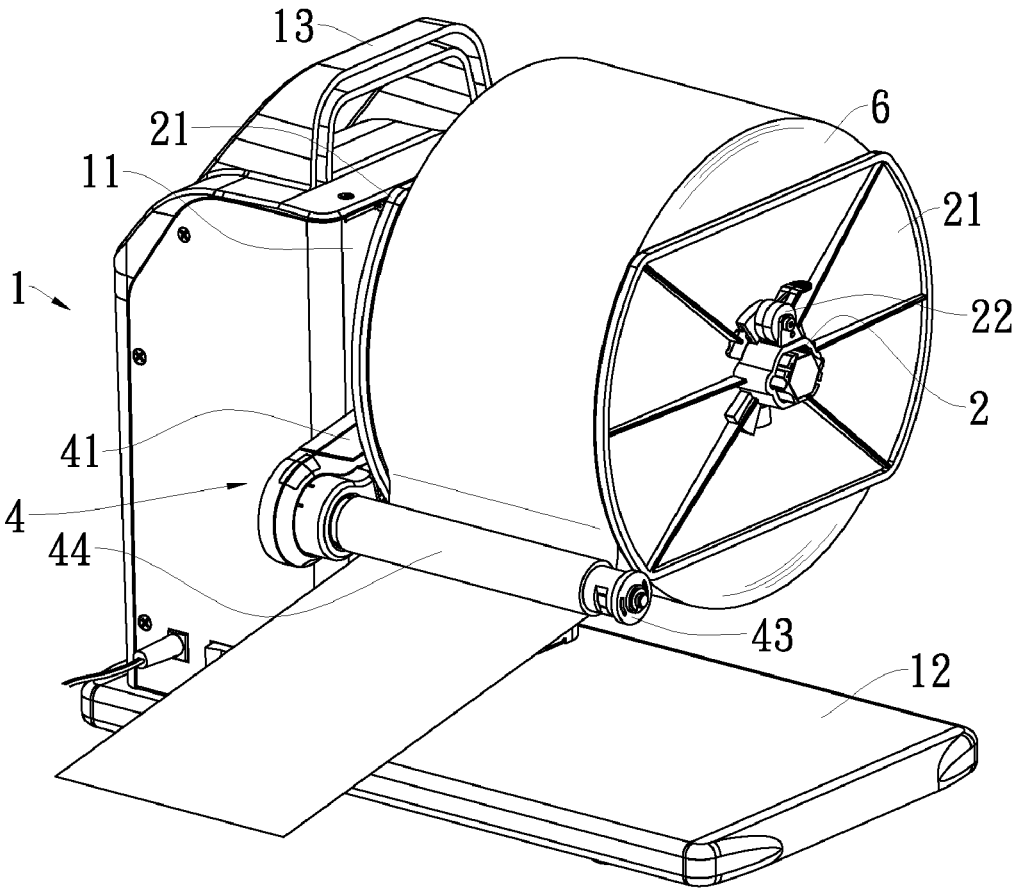
FIG. 1 is a perspective view of an embodiment of the present invention.

First, referring to FIGS. 1 to 4, a general winding and feeding apparatus includes a base 1, a rotating shaft 2, a motor 3, a swing arm 4 and at least two light-coupled sensors (a first light-coupled sensor 51, second light-coupled sensor 52, etc.).

A standing wall 11 is disposed on the upper side of the base 1, and a bottom plate 12 is disposed on the bottom of the base 1. Where a handle 13 extends from the top of the standing wall 11, a bracket 111 is disposed in the standing wall 11 and a positioning hole 112 is disposed in the middle of one side of the standing wall 11.

The rotating shaft 2 used to engage with a spool 6, which is used for winding or releasing a material, and is installed on the upper side of the standing wall 11 of the base 1, where a plate 21 is respectively installed on both sides of the rotating shaft 2, thereby clamping and fixing the spool 6, and a fixing element 22 for fixing and positioning the plate 21 and the rotating shaft 2, which may be, for example, a rotating handle bar, and is installed on the outer side of the plate 21 and the rotating shaft 2.

The motor 3 is driven using a digital variable frequency method, and is installed on the bracket 111 of the standing wall 11 of the base 1, and connected to the rotating shaft 2 through a gear train 31, thereby providing rotating power.

The swing arm 4 has a swing arm seat 41, where a fixed shaft 42 at one end of the swing arm seat 41 is disposed on the standing wall 11. A positioning hole plate 421 is disposed on the fixed shaft 42, and a rod 43 is disposed on another end of the swing arm seat 41, where a silicone rotating shaft 44 is disposed around the rod 43, thereby extending across a traveling material. Furthermore, a grating wheel 45 is installed on the inner end of the rod 43.

The first light-coupled sensor 51 is used for detecting the rotating speed of the rod 43 and is installed in the swing arm seat 41 of the swing arm 4 at a position that corresponds to the grating wheel 45 of the rod 43. The second light-coupled sensor 52 is installed in the standing wall 11 of the base 1 at a position that corresponds to the positioning hole plate 421 of the fixed shaft 42 of the swing arm 4; the swing position of the swing arm 4 can thus be detected based upon hole sites disposed around the positioning hole plate 421 as the swing arm 4 moves, where a coding, such as Gray coding, may be adopted for the coding of the positioning hole plate 421, thereby decreasing incorrect code reads and increasing the accuracy of positioning determination.

Referring again to FIGS. 2 and 4, the motor 3 may be a stepper motor, and a gear train 31 connected thereto may be installed with a grating 32, and a third light-coupled sensor 53 additionally installed at a corresponding position on the bracket 111 may be employed as an out-of-step sensor used to detect whether the motor 3 is acting normally or not. In addition, fan blades 33 may be installed on the grating 32, thus allowing the grating 32 to detect out-of-step conditions and to carry away heat produced from the motor 3 by circulating air induced by the rotation of the fan blades 33 when the grating 32 is rotated, thereby cooling the motor 3 at the same time.

Referring to FIGS. 2 and 3 again, an indication lamp 46 may respectively be installed inside the left and right sides of the swing arm seat 41 of the swing arm 4 while the embodiment present invention device is operating, thereby working in conjunction with the rotating shaft 2 to light up to indicate whether the rotation thereof is clockwise or anticlockwise, allowing a user to differentiate easily whether the machine is acting in a winding or feeding state. In addition, referring again to FIG. 2, an elastic locking element 47 may be installed in the middle of the swing seat 41, allowing the swing arm 4 to be brought home to stop and retain in the positioning hole 112 of the standing wall 11 when it is not in use, thereby preventing the swing arm 4 from swinging freely and being damaged while being transported.

Figure 5:
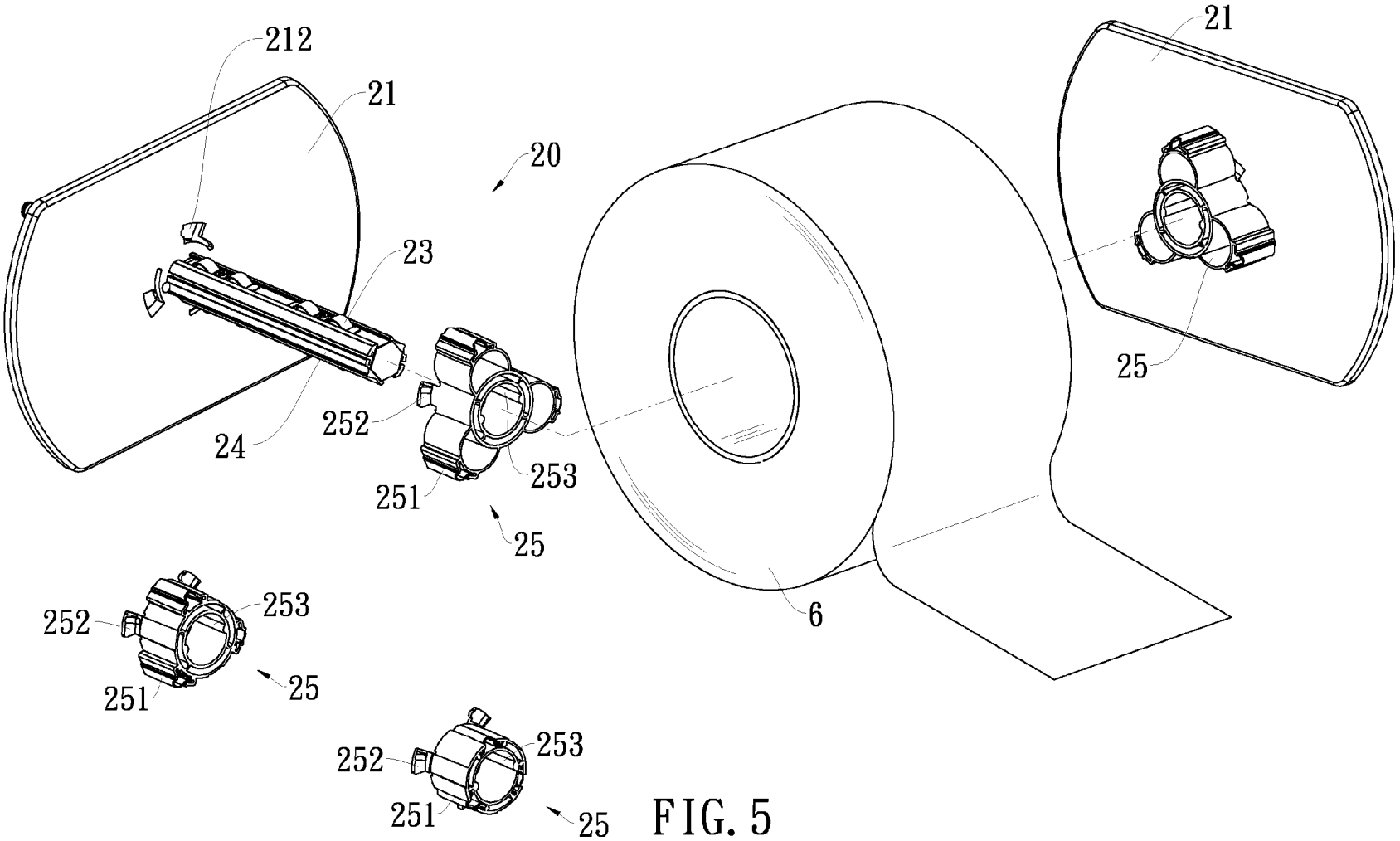
FIG. 5 is an exploded view of a spool axle center fixing module of an embodiment of the present invention.

In addition, referring to FIG. 5, a fast spool axle center fixing module 20 may further be disposed on the rotating shaft 2 according to an embodiment of the present invention. The fast spool axle center fixing module 20 is provided by configuring a plurality of distally separated elastic engagement elements 23 on the rotating shaft 2, and a slide 24 is used for engaging with a plurality of spool fixing elements 25, each having a hole 253, on which a plurality of sliding masses corresponding to the slide 24 are disposed. At least three elastic projecting masses 251 are disposed radially around the outside of each spool fixing element 25, and engagement flanges 252 are disposed on one side of each spool fixing element 25. Furthermore, engagement holes 212 permit the engagement flanges 252 of the spool fixing elements 25 to be placed therein and rotated to engaged therewith, and are disposed correspondingly on the plate 21 of the rotating shaft 2. The external portions of the plurality of spool fixing elements 25 may be designed to various different specifications so as to be able to engage with various different sizes of spool 6 axle centers, thereby achieving the practical object of the quick changing of spools 6.

Adopting digital variable frequency technology to drive the motor 3 makes embodiments of the present invention more electrically efficient and the clockwise and anticlockwise rotation controls easy to implement. In addition, because the indication lamps 46 are respectively oppositely disposed inside the left and right sides of the swing arm seat 41 of the swing arm 4, and light up separately depending upon which direction the motor 3 is rotating, such embodiments of the present invention can be used as a winder as well as feeder. Consequently, the various embodiments contemplate broad uses and can be used in various different industries, such as the continuous winding of long-striped wire, paper or metal materials. Although the following application uses paper winding as an example, it should be understood that the invention is not limited to such embodiments.

Referring again to FIG. 2, when embodiments of the present invention are not in operation or storage, the swing arm 4 is engaged with the positioning hole 112 of the standing wall 11 of the base 1 by way of the elastic locking element 47 and retained there temporarily, thereby preventing the swing arm 4 from swinging arbitrarily and becoming damaged, thereby securing embodiments of the present invention conveniently during the transportation thereof.

Figure 2:
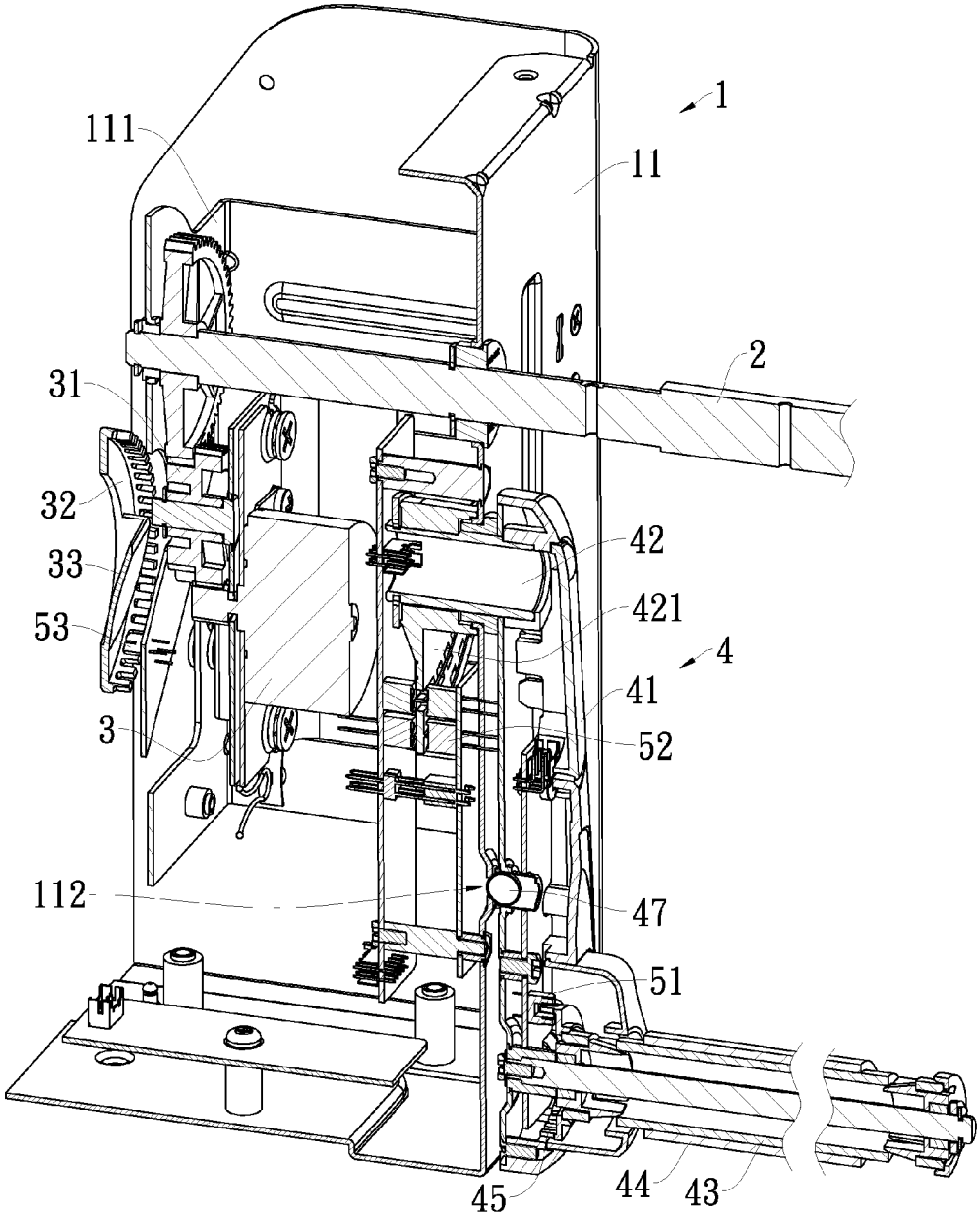
FIG. 2 is a partial cross sectional view of an embodiment of the present invention.
Figure 3:
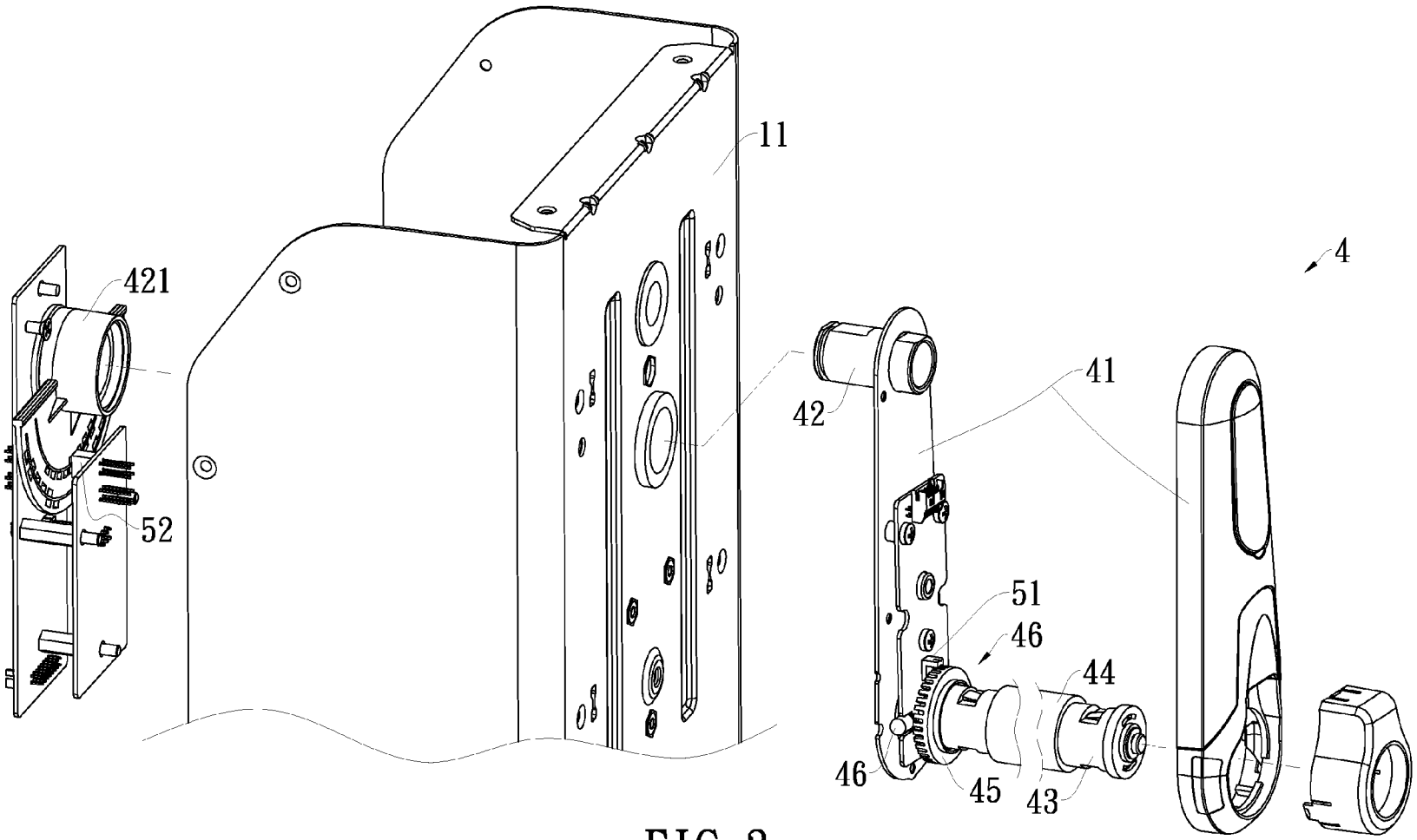
FIG. 3 is a partial exploded view of an embodiment of the present invention.
Figure 4:
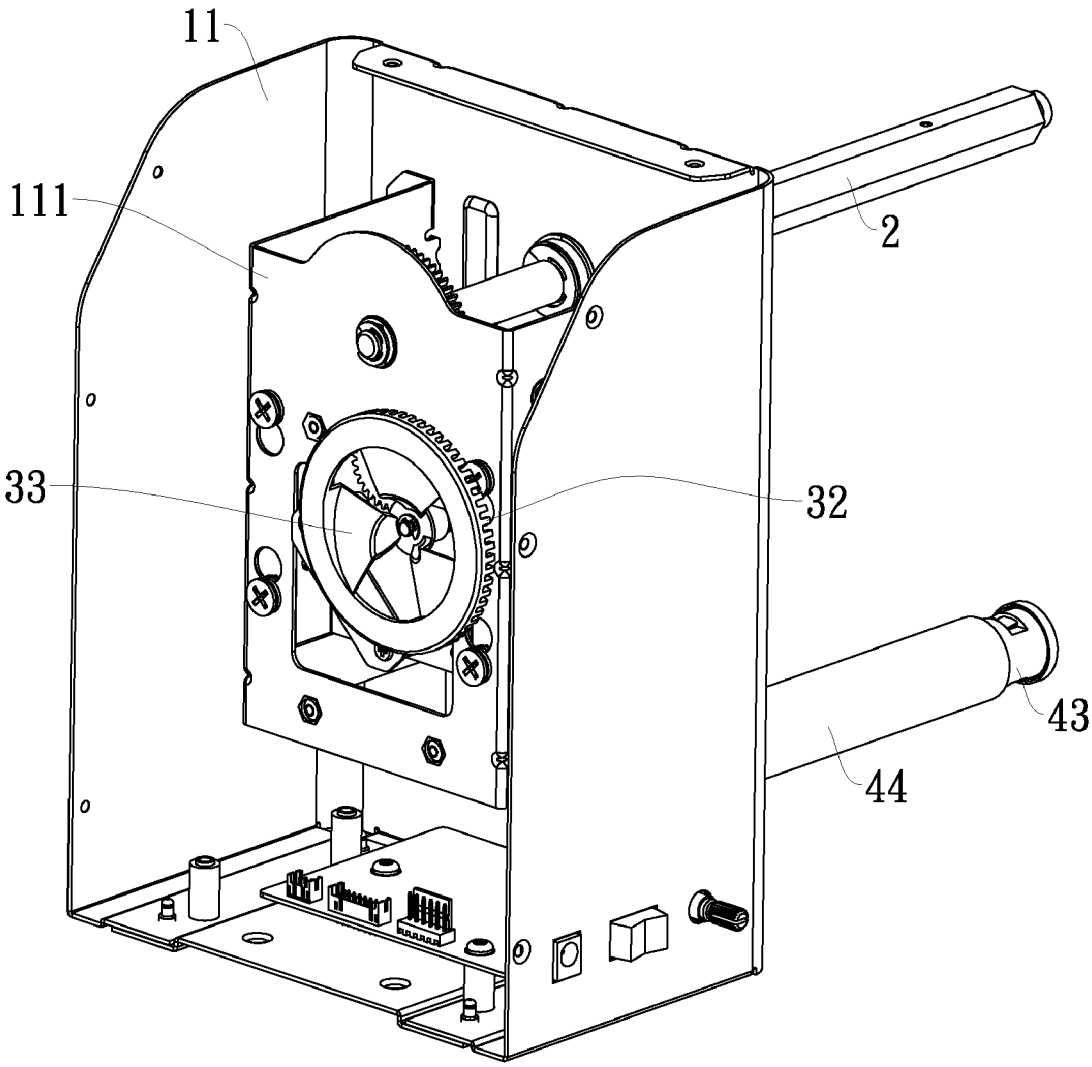
FIG. 4 is a perspective view of a portion of an embodiment of the present invention.
Figure 6:
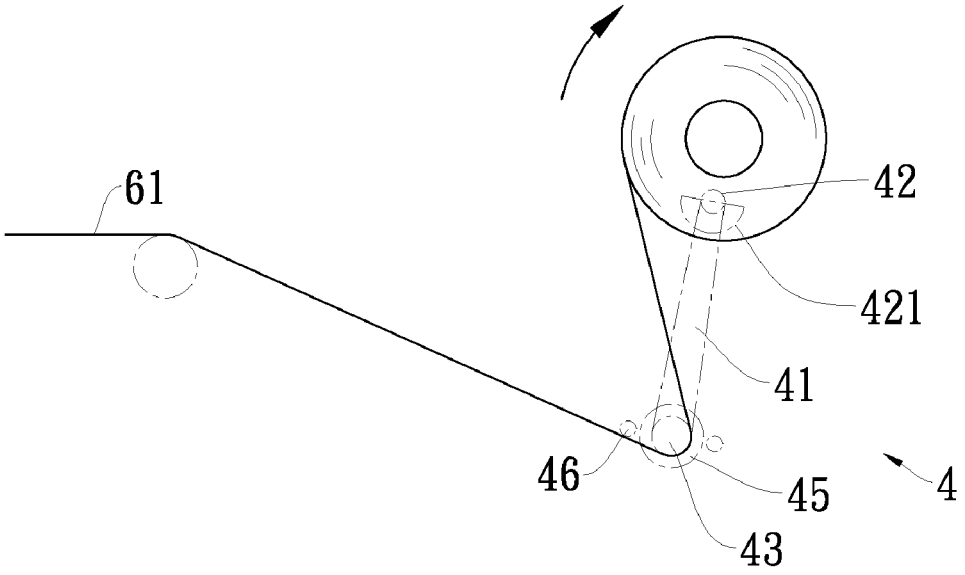
FIG. 6 is a schematic view of a paper winding action of an embodiment of the present invention.

When an embodiment of the present invention is used for paper winding, as shown in FIGS. 2, 3 and 6, one end of the paper 61 output from a front-end device such as a printer (not shown in the figures) is fed so as to prop against and pass through the rod 43 of the swing arm 4, and wound around the rotating shaft 2, where the force of friction can be increased by way of the silicone rotating shaft 44 surrounding the rod 43, ensuring that the paper 61 can be attached to the rod 43 more tightly and rotated while being fed, and allowing the grating wheel 45 of the rod 43 to rotate synchronously and the corresponding first light-coupled sensor 51 to receive light to generate high and low signals. Thereafter, the traveling speed of the paper can be calculated accurately, and whether the paper winding shaft is full with paper or not can be determined so as to avoid faults.

Figure 7:
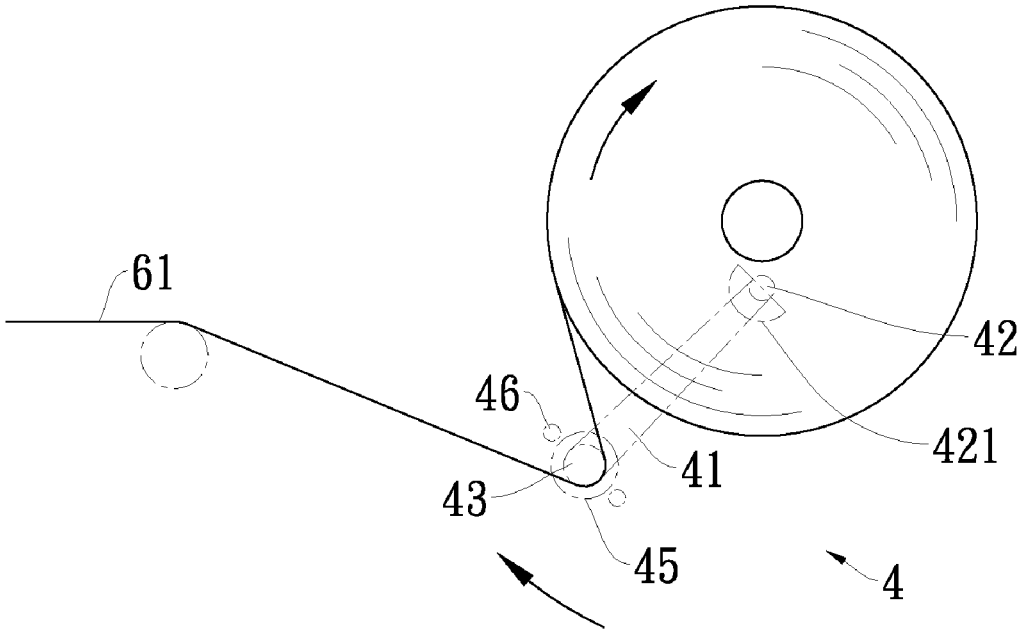
FIG. 7 is another schematic view of a paper winding action of an embodiment of the present invention.
Figure 8:
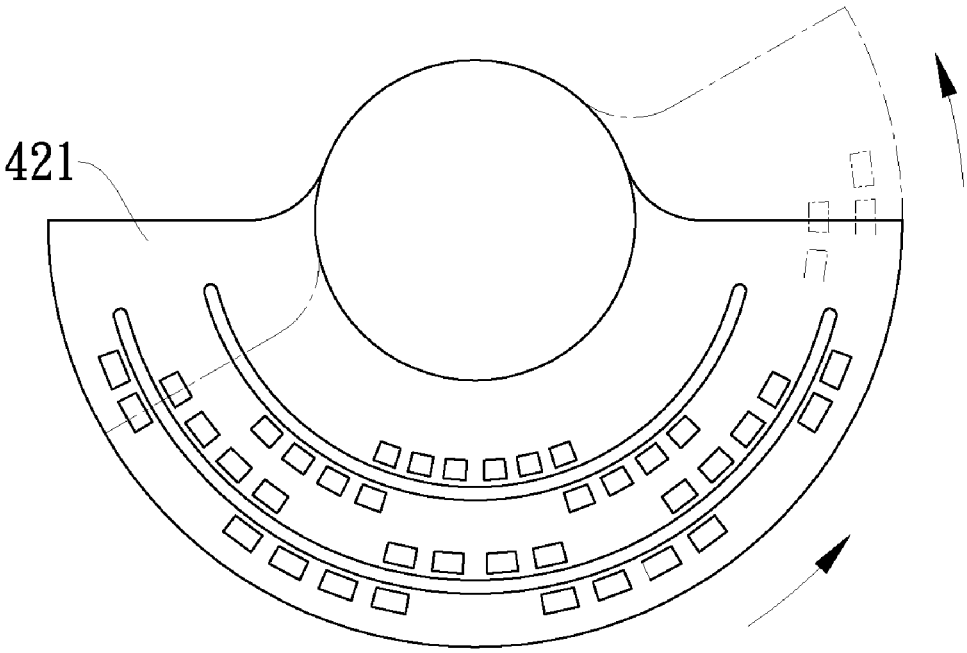
FIG. 8 is a schematic view of a rotation of a positioning hole plate of an embodiment of the present invention.

While material winding is proceeding, as shown in FIGS. 2, 7 and 8, the distance between every two adjacent winding loops of paper 61 changes with the winding radius of the paper 61, increasing gradually, and the rod 43 is then raised correspondingly, allowing a swing angle of the swing arm 4 to be changed correspondingly. Because the positioning hole plate 421 on the fixed shaft 42 is moved in succession at the same time that the swing arm 4 is rotated, an angular change of movement of the swing arm 4 can be accurately determined via the Gray coding of the second light-coupled sensor 52 to calculate a value of the winding radius of the paper 61, thereby generating feedback to modulate the rotational speed of the motor 3; the rotational speed thereof is relatively reduced as the winding radius of the paper 61 increases. Therefore, changing the paper feeding speed can obtain corresponding adjustments and achieve the practical object of maintaining a constant feeding speed of the paper 61, thereby allowing the inner and outer circles of the wound paper 61 to tighten uniformly, and thus providing the best winding effect.

In addition, referring again to FIGS. 2, 3 and 4, because the fan blades 33 are installed on the grating 32 of the gear train 31, they can cool the motor 3 as the gear train 31 rotates normally. Furthermore, to maintain the precision of the stepper motor 3 and to avoid stalling of the motor, the third light-coupled sensor 53 detects the action change of the grating 32 disposed on the gear train 31 connected to the motor 3 to measure whether the motor 3 and the grating 32 are acting synchronously or not; the motor 3 is deactivated if not.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A general winding and feeding apparatus, comprising:

a base, a standing wall disposed on an upper side thereof, and a bottom plate disposed on a bottom thereof;

a rotating shaft disposed on an upper side of said standing wall of said base, and used for engaging with a spool;

a digital variable frequency motor installed in said standing wall of said base and connected with said rotating shaft, thereby providing rotating power to the shaft;

a swing arm, one end thereof having a fixed shaft disposed on said standing wall, a positioning hole plate disposed on said fixed shaft, another end thereof having a rod thereby allowing the swing arm to be extend across a traveling material, a grating wheel installed in said rod; and at least two light-coupled sensors, a first light-coupled sensor installed in said swing arm at a position corresponding to said grating wheel of said rod of said swing arm to detect a rotational speed of said rod, a second light-coupled sensor thereof installed in said standing wall of said base at a position corresponding to said positing hole plate of said fixed shaft of said swing arm to detect a swing position of said swing arm and generating feedback to modify said motor rotating speed so as to permit traveling of said material to be maintained at a constant speed while said material is wound or fed.

2. The general winding and feeding apparatus according to claim 1, wherein Gray coding is utilized to encode said positioning hole plate.

3. The general winding and feeding apparatus according to claim 2, wherein a plate for clamping and fixing said spool is further disposed on two sides of said rotating shaft, and a fixing element is installed on an outside of said plate and said rotating shaft to fix said plate.

4. The general winding and feeding apparatus according to claim 3, wherein a handle extends from an upper end of said standing wall of said base, a bracket is disposed in said standing wall, and a positioning hole is disposed on the middle of one side of said standing wall.

5. The general winding and feeding apparatus according to claim 4, wherein said digital variable frequency motor is a stepper motor installed on said bracket of said standing wall of said base, a gear train installed between said stepper motor and said rotating shaft and connected thereto, a grating disposed on said gear train, and a third light-coupled sensor for detecting whether said stepper motor is operating normally is further installed on said bracket.

6. The general winding and feeding apparatus according to claim 5, wherein fan blades are installed on said grating of said gear train.

7. The general winding and feeding apparatus according to claim 4, wherein a swing arm seat is further installed between said fixed shaft and said rod of said swing arm, and indication lamps configured to light up to display which direction said rotating shaft is rotated in are further respectively installed on left and right sides of said swing arm seat; and an elastic locking element is further installed in the middle of said swing arm seat at a position corresponding to said positioning hole disposed in the middle of said side of said standing wall of said base, allowing said swing arm to be brought home and retained while not in use.

8. The general winding and feeding apparatus according to claim 7, wherein a silicone rotating shaft is disposed around said rod of said swing arm.

9. The general winding and feeding apparatus according to claim 7, wherein a fast spool axle center fixing module is further installed on said rotating shaft, said fast spool axle center fixing module comprises elastic engagement elements disposed on said rotating shaft that slide on sides of said rotating shaft and used for aligning and engaging with similarly shaped sliding masses in inner holes of a plurality of spool fixing elements, at least three elastic projecting masses disposed equidistantly around an outside of each spool fixing element, and engagement flanges are disposed on a side of said spool fixing elements; and wherein engagement holes are disposed on said plate of said rotating shaft configured so that the engagement flanges are capable of rotating in and engaging therewith; outsides of said spool fixing elements having different specifications, thereby allowing differently sized spools to be engaged therewith.

10. The general winding and feeding apparatus according to claim 1, wherein a plate for clamping and fixing said spool is further disposed on two sides of said rotating shaft, and a fixing element is installed on an outside of said plate and said rotating shaft to fix said plate.

11. The general winding and feeding apparatus according to claim 10, wherein a handle extends from an upper end of said standing wall of said base, a bracket is disposed in said standing wall, and a positioning hole is disposed on the middle of one side of said standing wall.

12. The general winding and feeding apparatus according to claim 11, wherein said digital variable frequency motor is a stepper motor installed on said bracket of said standing wall of said base, a gear train installed between said stepper motor and said rotating shaft and connected thereto, a grating disposed on said gear train, and a third light-coupled sensor for detecting whether said stepper motor is operating normally is further installed on said bracket.

13. The general winding and feeding apparatus according to claim 12, wherein fan blades are installed on said grating of said gear train.

14. The general winding and feeding apparatus according to claim 11, wherein a swing arm seat is further installed between said fixed shaft and said rod of said swing arm, and indication lamps configured to light up to display which direction said rotating shaft is rotated in are further respectively installed on left and right sides of said swing arm seat; and an elastic locking element is further installed in the middle of said swing arm seat at a position corresponding to said positioning hole disposed in the middle of said side of said standing wall of said base, allowing said swing arm to be brought home and retained while not in use.

15. The general winding and feeding apparatus according to claim 14, wherein a silicone rotating shaft is disposed around said rod of said swing arm.

16. The general winding and feeding apparatus according to claim 14, wherein a fast spool axle center fixing module is further installed on said rotating shaft, said fast spool axle center fixing module comprises elastic engagement elements disposed on said rotating shaft that slide on sides of said rotating shaft and used for aligning and engaging with similarly shaped sliding masses in inner holes of a plurality of spool fixing elements, at least three elastic projecting masses disposed equidistantly around an outside of each spool fixing element, and engagement flanges are disposed on a side of said spool fixing elements; and wherein engagement holes are disposed on said plate of said rotating shaft configured so that the engagement flanges are capable of rotating in and engaging therewith; outsides of said spool fixing elements having different specifications, thereby allowing differently sized spools to be engaged therewith.

* * * * *